US008907200B2

(12) United States Patent
Bekerman

(10) Patent No.: US 8,907,200 B2
(45) Date of Patent: Dec. 9, 2014

(54) TRANSDUCER ASSEMBLY MOUNTING KIT WITH FEEDBACK REDUCTION DEVICE FOR INSTALLATION INTO THE SOUND HOLE OF AN ACOUSTIC GUITAR

(76) Inventor: Benjamin Randal Bekerman, Arlington, TX (US)

( * ) Notice: Subject to any disclaimer, the term of this patent is extended or adjusted under 35 U.S.C. 154(b) by 0 days.

(21) Appl. No.: 13/454,081

(22) Filed: Apr. 23, 2012

(65) Prior Publication Data

US 2013/0276621 A1 Oct. 24, 2013

(51) Int. Cl.
*G10H 3/14* (2006.01)

(52) U.S. Cl.
USPC ..... 84/727

(58) Field of Classification Search
USPC ..... 84/726, 727
See application file for complete search history.

(56) References Cited

U.S. PATENT DOCUMENTS 4,394,830 A * 7/1983 Damiano ..... 84/726
4,501,186 A * 2/1985 Ikuma ..... 84/726
4,854,210 A * 8/1989 Palazzolo ..... 84/726
5,012,716 A * 5/1991 Pagelli ..... 84/727
5,438,158 A * 8/1995 Riboloff ..... 84/727
5,614,688 A * 3/1997 Donnell ..... 84/743
5,883,322 A * 3/1999 Baker ..... 84/453
6,043,422 A * 3/2000 Chapman ..... 84/723
6,441,293 B1 * 8/2002 LaBarbera ..... 84/723
7,015,390 B1 * 3/2006 Rogers ..... 84/723
7,851,684 B1 * 12/2010 Anderson et al. ..... 84/297 R

* cited by examiner

*Primary Examiner* — Jeffrey Donels

(57) ABSTRACT

The invention provides elements used to attach a standard magnetic pickup, in conjunction with a feedback reduction device, into the sound hole of an acoustic guitar in a manner that does not alter the inherent sound characteristics of the underlying guitar. The approach put forward provides a significant advantage by providing the ability to install a broad range of commercially available standard magnetic pickups, which combined with the feedback reduction device, provides the capability to achieve high gain amplification utilizing an open body acoustic guitar while eliminating the highly objectionable squeal that is customary in this type of application. The invention consists of a basic modification kit: the pickup mounting elements, the pickup itself, the feedback reduction device, the metalized guitar strings, the conductive string anchor bracket, and the interconnect cable assembly.

5 Claims, 7 Drawing Sheets

Basic Modification Kit
Exploded View

Basic Modification Kit
Exploded View

Extended Modification Kit
Exploded View

Extended Modification Kit
Top View of Installed Configuration

Pickup Holder with Transducer
Exploded View

Position Capture Stops
Isometric View

Modified Feedback Reduction Device
Isometric View

Conductive Guitar String Anchor Bracket
Isometric View

TRANSDUCER ASSEMBLY MOUNTING KIT WITH FEEDBACK REDUCTION DEVICE FOR INSTALLATION INTO THE SOUND HOLE OF AN ACOUSTIC GUITAR

CROSS REFERENCE TO RELATED APPLICATIONS

The present application is related to U.S. Pat. No. 4,394,830 A, issued Jul. 26, 1983, for FEEDBACK REDUCER FOR AN ACOUSTIC ELECTRIC GUITAR, by Paul J. Damiano, Manchester, Conn.

The present application is related to U.S. Pat. No. 4,501,186 A, issued Feb. 26, 1985, for PICKUP DEVICE FOR STRINGED MUSICAL INSTRUMENT, by Masahiro Ikuma, Hamakita, JP.

The present application is related to U.S. Pat. No. 4,854,210 A, issued Aug. 8, 1989, for DETACHABLE ELECTRIC GUITAR PICKUP SYSTEM, by Nicholas P. Palazzolo, Lomita, Calif.

The present application is related to U.S. Pat. No. 5,012,716 A, issued May 7, 1991, for ROTATABLE PICK-UP HEAD FOR ELECTRIC GUITAR, by Claudio Pagelli, Chur, CH.

The present application is related to U.S. Pat. No. 5,438,158 A, issued Aug. 1, 1995, for PICKUP, INCLUDING MOUNTING APPARATUS THEREOF, FOR A STRINGED MUSICAL INSTRUMENT HAVING A SOUND HOLE, by John T. Riboloff, Antioch, Tenn.

The present application is related to U.S. Pat. No. 5,614,688 A, issued Mar. 25, 1997, for TRANSDUCER SYSTEM FOR ACOUSTIC INSTRUMENTS, by Kenneth D. Donnell, Chico, Calif.

The present application is related to U.S. Pat. No. 5,883,322 A, issued Mar. 16, 1999, for FEEDBACK MINIMIZING DEVICE, by Michael R. Baker, Minden, Nev.

The present application is related to U.S. Pat. No. 6,043,422 A, issued Mar. 28, 2000, for COMPARTMENTALIZED PICKUP MODULE FOR STRINGED MUSICAL INSTRUMENTS, by Emmett H. Chapman, Woodland Hills, Calif.

The present application is related to U.S. Pat. No. 6,441,293 B1, issued Aug. 27, 2002, for SYSTEM FOR GENERATING PERCUSSION SOUNDS FROM STRINGED INSTRUMENTS, by Anthony LaBarbera, New Milford, N.J.

The present application is related to U.S. Pat. No. 7,015,390 B1, issued Mar. 21, 2006, for TRIAD PICKUP, by Wayne A. Rogers, Titusville, Fla.

The present application is related to U.S. Pat. No. 7,851,684 B1, issued Dec. 14, 2010, for ANCHOR BRACKET FOR MUSICAL INSTRUMENT STRINGS, by Anderson et al, Renton, Wash.

| | |
|---|---|
| FEDERALLY SPONSORED RESEARCH | Not Applicable |
| SEQUENCE LISTING OR PROGRAM | Not Applicable |
| US CLASS | 84/267; 84/453; 84/725 |
| FIELD OF SEARCH | 84/267, 453, 723, 725, 743 |

BACKGROUND

1. Field

This interface device application relates to the field of acoustic guitars, specifically to where the user requires the capability to install a transducer into the sound hole of said acoustic guitar for the purpose of high gain amplification without the common presence of objectionable feedback.

2. Prior Art

Amplification of an acoustic guitar is required for performances in public settings. This amplification is commonly initiated by holding the guitar adjacent to a stationary microphone, or mounting a microphone on the face of the guitar in or near the sound hole. In this common arrangement, if uncommon care in the placement of the equipment is not taken, then highly objectionable feedback noise results, thus limiting the ability to provide high gain acoustic guitar amplification using this typical technique. The current invention overcomes these existing limitations and enables high gain amplification utilizing an acoustic guitar.

Over the years there have been various devices which can reduce or eliminate this objectionable feedback, but each of these earlier devices has limitations which this current invention is designed to overcome. Further, the feedback reduction devices did not necessarily directly attach the transducer within the sound hole, or provide a means to electrically complete the circuit. The discussion that follows in this section will discuss prior art and how each of these by themselves do not fully address overcoming the problems associated with getting high gain amplification when utilizing an acoustic guitar. Whereas the current patent application addresses each of the issues as part of an overall systematic approach to address the mounting of the transducer within the sound hole in a manner that greatly reduces the feedback, while also providing a means to electrically close the circuit's to enable high gain amplification utilizing an acoustic guitar.

U.S. Pat. No. 4,394,830 A to Damiano describes a plug to cover the sound hole of an acoustic guitar. The plug completely covers the hole. This technique does eliminate the amplification feedback; however the underlying sound of the acoustic guitar may be significantly affected. Completely covering the sound hole alters the inherent sound of the underlying acoustic guitar, whereas the current invention introduces significantly less alteration to the underlying sound, while still allowing the high gain amplification.

U.S. Pat. No. 4,501,186 A to Ikuma describes a musical device for stringed musical instruments. This prior art provides a means of mounting pickups within the sound hole, as well as allowing for the pick-up to be detachable. However, this prior art does not address a means to significantly reduce, or eliminate, the objectionable feedback that normally occurs in the amplified acoustic guitar application, whereas the current patent application does address this objection.

U.S. Pat. No. 4,854,210 A to Palazzolo describes a detachable electric guitar pick-up system. This prior art is not applicable to an acoustic guitar application, and thus the feedback reduction implementation is not present since it is not required, whereas the current patent application addresses the acoustic guitar application and the need for feedback reduction for successful implementation.

U.S. Pat. No. 5,012,716 A to Pagelli describes rotatable pick-up head for electric guitar. This prior art is applicable to electric guitars and allows and the pick-up to be rotated; however it does not address the feedback reduction necessary for use on an acoustic guitar configuration. Whereas the current patent application specifically addresses the elimination of feedback associated with amplification of an acoustic guitar while still allowing rotational adjustment of the pick-up within the sound hole.

U.S. Pat. No. 5,438,158 A to Riboloff describes a pickup, including mounting apparatus thereof, for a strained musical instrument having a sound hole. This prior art allows for the mounting of the pick-up within the acoustic guitar sound hole, however it does not do that in combination with the feedback reduction device. Whereas the current that an application directly addresses a means to mount the pick-up, allow would just meant of the pick-up within the sound hole, and has built in feedback reduction.

U.S. Pat. No. 5,614,688 A to Donnell describes a transducer system for acoustic instruments. This prior art provides a means for locating a pickup within the guitar, as well as detachable plugs for interfacing to the instrument. This prior art implementation does not address feedback associated with high gain amplification associated with an acoustic guitar, whereas overcoming this limitation is one of the benefits of the currently applied for patent.

U.S. Pat. No. 5,883,322 A to Baker describes a feedback minimizing device. This prior art device completely covers the sound hole. Completely covering the sound hole can significantly alter the inherent sound of the underlying acoustic guitar, whereas the current invention introduces significantly less alteration to the underlying sound since it retains much of the sound hole opening.

U.S. Pat. No. 6,043,422 A to Chapman describes a compartmentalized pick-up module for stringed musical instruments. This prior art is intended four utilization on instruments which do not contain a resident cavity, whereas the current patent application specifically addresses the application associated with that acoustic guitar.

U.S. Pat. No. 6,441,293 B1 to LaBarbera describes a system for generating percussion sounds from stringed instruments. This prior art provides the means to mount various transducers within the hollow body of a guitar for the purpose of using those transducers as triggering mechanisms. Whereas the current patent application addresses transducers solely mounted in an acoustic guitar sound hole in a manner that eliminates inherent high gain feedback, while maintaining the essential underlying guitar sound characteristics.

U.S. Pat. No. 7,015,390 B1 to Rogers describes a triad pick-up. This prior art provides a means to mount multiple pickups within the sound hole of an acoustic guitar, as well as various optional electronic to controls and filters for each of the transducers. This prior art does not address elimination of the amplification feedback, whereas this feedback elimination in the presence of a transducer in the sound hole, is one of the primary purposes of the current patent application.

U.S. Pat. No. 7,851,684 B1 to Anderson describes an anchor bracket for musical instrument strings. The purpose of this prior art is to provide a means of quickly and securely attaching strings to the guitar. Where as in the current that an application the anchor bracket must be metallic and is used for the purpose of completing the electromechanical circuit between the guitar strings and the magnetic pick-up. This prior are serves as an element of the overall currently for applied for patent. This prior art is not claimed as part of this current patent application, but rather is an element of the overall patent application as described in the description section.

SUMMARY

The claimed invented device provides an interface mounting adapter which is used as a means to install a standard magnetic pickup into a sound hole of an acoustic guitar. In accordance with the embodiment described herein, the interface mounting adapter approach provides a significant advantage by providing the ability to install and remove a broad range of commercially available standard magnetic pickups. Further, the claimed invention is provided as a basic modification kit which consists of all of the elements needed to mount the pickup, the pickup itself, the feedback reduction device, the metalized guitar strings, a conductive string anchor bracket, and an interconnect cable assembly. In addition there is an extended modification kit which adds further capability to provide electronic magnetic transducer configuration switching as well as signal filtering with output level adjustment. With the claimed invention installs a magnetic transducer on an acoustic guitar, where the guitar can then be electrically interfaced with an external amplification system such that the combined arrangement is well resistant to the common problem of feedback squeal.

BRIEF DESCRIPTION OF THE DRAWINGS

A complete understanding of the present invention may be obtained by reference to the accompanying drawings, when considered in conjunction with the subsequent, detailed description, in which.

LIST OF REFERENCE NUMBERS

| Element reference number | Description |
|---|---|
| 10 | basic modification kit |
| 50 | extended modification kit |
| 105 | conductive string anchor bracket |
| 107 | bridge plate |
| 109 | bridge pins |
| 110 | transducer pickup holder |
| 112 | pickup holder dowel |
| 114 | rivet nut |
| 116 | transducer adjustment screw |
| 118 | alignment stop block |
| 120 | washer for stop block capture screw |
| 122 | capture screw |
| 124 | pickup holder thru-hole for transducer |
| 126 | pickup holder thru-hole for selection switch |
| 128 | multiple position selection switch |
| 130 | t-nut for alignment stop block capture screw |
| 132 | transducer positioning spring |
| 134 | transducer mounting flange |
| 138 | transducer |
| 140 | feedback reduction device |
| 142 | gasketing material |
| 144 | hole for pickup holder positioning dowel |
| 145 | sound hole |
| 146 | hole for pickup holder capture block screw |
| 150 | pair of position capture blocks |
| 160 | shielded cable assembly |
| 170 | output jack |
| 190 | metalized guitar strings |
| 192 | guitar string termination ball |
| 200 | switch box |
| 250 | control box |
| 300 | underside of the guitar top |
| 350 | top side of the guitar top |

DETAILED DESCRIPTION OF THE PREFERRED EMBODIMENT

Like elements and components will bear the same designations and numbering throughout the figures.

Figure 1:
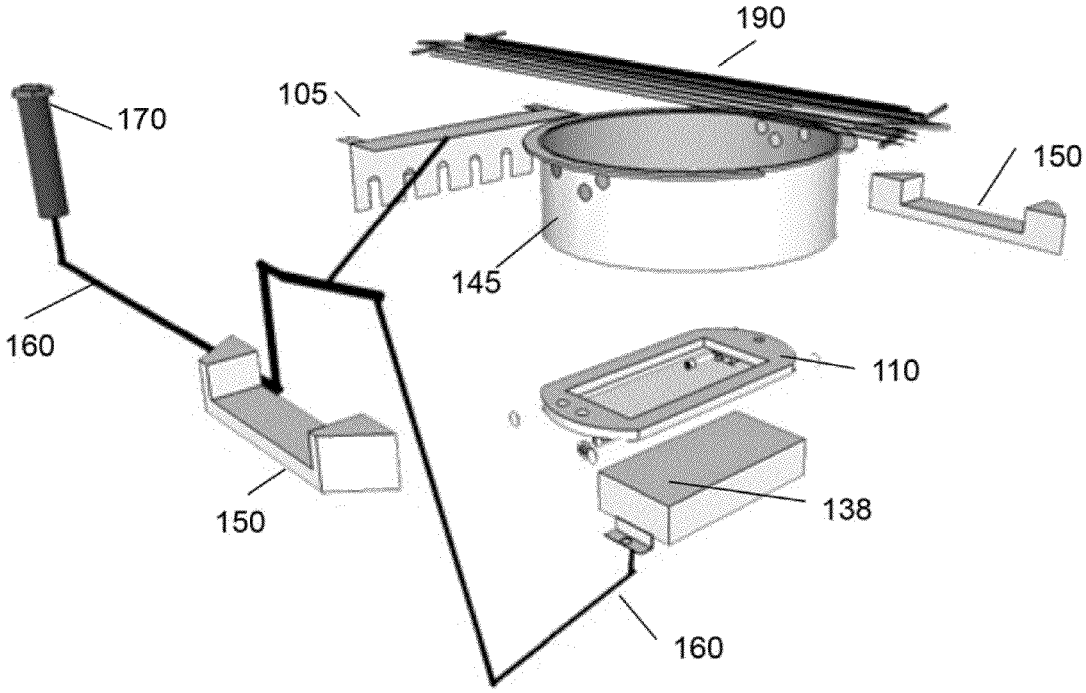
FIG. 1 is an exploded view of the basic modification kit showing the elements which comprise this grouping consisting of a pickup holder, a transducer, a feedback reduction device, a set of metalized guitar strings, a pair of position capture blocks, a conductive guitar string anchor bracket, a shielded cable assembly, and an output jack.

FIG. 1 is an exploded view of the basic modification kit 10 showing the elements which comprise this grouping consisting of a pickup holder, a transducer 138, a feedback reduction device 140, a set of metalized guitar strings 190, a pair of position capture blocks 150, a conductive guitar string anchor bracket, a shielded cable assembly 160, and an output jack 170.

The transducer pickup holder 110 is one of the more fundamentally essential pieces of this invention. The transducer pickup holder 110 serves as an interface between holding the transducer 138 and attaching to the feedback reduction device 140. The transducer pickup holder 110 can be made of various materials so long as those materials are structurally rigid and of lightweight, such as various woods as used in the manufacture of acoustic guitars. The shape of the transducer pickup holder 110 must be such that it fits inside the circular inner walls of the feedback reduction device 140, while the internal dimensions of the transducer pickup holder 110 must conform to the specific mounting requirements associated with the transducer 138 that is to be utilized in the application.

The transducer 138, as utilized in this embodiment, is a commercial magnetic pickup, but can be any other type of pickup that would benefit from being used in conjunction with the feedback reduction device 140 associated with an acoustic guitar sound hole 145 type of application. The magnetic transducer 138 can be of a single coil variety or a double coil which is commonly termed a Humbucker pickup.

The feedback reduction device 140 is used as a structural element in this embodiment. The feedback reduction device 140 serves as interface to the acoustic guitar by direct attachment through the sound hole 145 located on the top side of the guitar top 350. The feedback reduction device 140 is typically made of a firm, but pliable material, such as a heavy gauge plastic or rubber, that can be deformed in such a manner as to enable tight fit into the sound hole 145 while the upper lip of the feedback reduction device 140 extends a little over the top of the sound hole 145 so as to prevent falling through the sound hole 145 and into the body of the acoustic guitar.

This mounting arrangement for the feedback reduction device 140 is adequate when only the feedback reduction device 140 itself is to be supported. However with the incorporation of this invention, the feedback reduction device 140 requires some modification so that when the heavier component's, which are added to the inside walls of the feedback reduction device 140, do not result in causing the entire transducer 138 element grouping to sufficiently deform the upper lip of the feedback reduction device 140 such that the element grouping falls into the body of the acoustic guitar.

The guitar strings need to be constructed with metallic content in order to electrically/magnetically interact with the magnetic transducer 138. As such the guitar strings in this application are termed metalized guitar strings 190 which are commonly used in electric guitar application, but not universally used in acoustic guitar applications. These guitar strings can be of any gauge set chosen by individual taste. The anchor and of commercially available guitar strings terminate via a guitar string termination ball 192 or equivalent. Utilizing the guitar string termination ball 192 the guitar string can be terminated into the conductive string anchor bracket 105. A cable connection to the conductive string anchor bracket 105 then enables the ability to electrically close the grounding circuit associated with the interaction of the metalized guitar strings and the magnetic transducer.

There are a pair of position capture blocks 150 which are attached to the underside of the guitar top and are configured with a slot that interfaces with a capture pin that is anchored to the transducer pickup holder 110 such that the holder cannot move in an up or down direction, but can be rotated within the sound hole 145. The capture pin when inserted into the resulting slot that is made by the pair of position capture blocks 150 keeps the transducer 138 and its mounting structure from falling into the body of the guitar.

The conductive string anchor bracket 105 mounts to the underside of the guitar top and is aligned underneath the bridge plate 107 so that the metalized guitar strings 190 passing through the holes in the bridge plate 107 can be captured by the slots contained on the conductive string anchor bracket 105. The purpose of the conductive string anchor bracket 105 is to mechanically capture the guitar string termination ball 192 in a manner where the metalized guitar strings 190 can be electrically connected in the circuit to enable the use of the magnetic pickup in a manner that is hardened against noise pickup or feedback either from other acoustic instruments or electromagnetic interferences from other electronics.

The shielded cable assembly 160 is used to interconnect all of the electronic elements used in this application. This shielded cable assembly 160 may be of light weight and maybe flexible. The purpose of this shielding is to protect the electronics from picking up external signals which would then corrupt the output signal, while at the same time the shielded cable assembly 160 contains any signals that are internally generated from escaping and adversely affecting other circuits. This shielding aids in the ability to use this equipment in conjunction with other musicians who may be in close proximity with other electronics.

The output jack 170 is a standard commercially available panel mounted guitar jack which is utilized to enable a electrical and mechanical interface between the guitar and external electronics.

Figure 2:
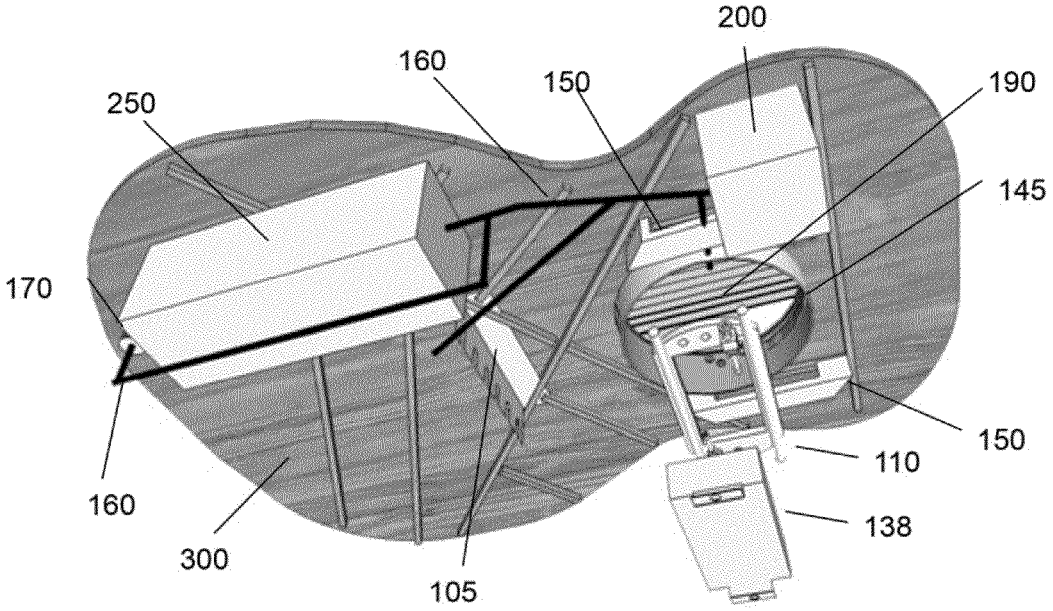
FIG. 2 is an exploded view of the extended modification kit as viewed from the underside of the guitar top which includes all of the elements within the basic modification kit, along with the addition of a switch box and a control box which in combination provides a means to electronically reconfigure the transducer and also provides a means to independently electronically filter the transducer signal as that resulting signal is routed towards the output jack.

FIG. 2 is an exploded view of the extended modification kit 50 as viewed from the underside of the guitar pop which includes all of the elements contained in the basic modification kit 10, along with the addition of a switch box 200 and a control box 250 which in combination provides a means to electronically configure the transducer 138 and also provides a means to independently electronically filter the transducer 138 signal as that resulting signal is routed towards the output jack 170.

The switch box 200 enables the ability to electronically change the electrical configuration of the transducer 138 via a switch knob located on the top side of the guitar top 350. For example in that case where using a double coil pickup, such as a Humbucker, this electronic switch arrangement would pick up the four electrical leads coming off of the transducer 138 and enable one to get at least six different combinations of the electrical effects from that one transducer 138. Each of these electrical combinations provides a different sound characteristic such that an individual player can change the sound of the instrument by selecting a position on the switch box 200. In this double coil example, the combinations might be: two coils in series, or two coils in parallel, or a single coil from one side, or the single coil from the other side, or two coils in series but not in phase, or two coils in parallel but not in phase, etc. Similar electrically reconfigurable configurations are possible for other transducer 138 types and combinations.

The switch box 200 and the control box 250 are enclosed such that electromagnetic radiation cannot get in or out. In this application of the invention, individual enclosures were used, however other configurations may also be used utilizing more enclosures or less enclosures. This switch box 200 housing, as well as the control box 250 housing, can be metal, such as aluminum, but can also be other materials which contain an electrically conductive film, conductive paint, or conductive spray for example, which would serve the same electromagnetic shielding purpose.

The shape of the switch box 200 can be square, as shown in the figure, but can also be any other shape, such as cylindrical, so long as the shape is sized to hold the switch mechanism and still fit inside the guitar body. One of the features of the switch box 200 is that it must be able to be installed in a manner where it will not rotate, or otherwise move, due to the repetitive motion of the switching mechanism on the top side of the guitar top 350. In the figure, this anti-rotation feature is accommodated by locating one of the switch box 200 edges against one of the internal support struts on the underside of the guitar top 300, such that rotation cannot take place. If one were to use a cylinder shaped switch box 200 housing one would then have to have some sort of stop/capture mechanism to accomplish the equivalent anti-rotation function.

The control box 250 accepts an input from the switch box 200 and then provides a filtered output signal via the shielded cable assembly 160 to the output jack 170. The filter function served by the control box 250 may include: master volume control, mid-cut control, and tone control for example. The control box 250 allows for numerous continuously variable filtering functions to be accomplished by electronic modification of the characteristics of the resulting electrical signal being sent to the output jack 170. In this application the control box 250 contains passive elements only which provide various filtering functions which interact with specific narrowband audio frequencies. However in other applications, should one want to use active circuits which require electrical power, that can be implemented as well with this general configuration.

There are also alternate locations available for the control circuits and knobs, which are represented by the switch box 200 and control box 250, such as their being located on the sides of the guitar, or even the backside of the guitar, which would then result in eliminating the need to permanently modify the top side of the guitar top 350 should one desire that aesthetic.

There are also alternate physical configurations and locations available for the switch box 200 and the control box 250 which would utilize miniature controls and circuits versus the standard sized controls and circuits which are shown for the embodiment represented in the current drawings. The physical locations of these controls and the physical size of these controls is an aesthetics option that does not alter the overall functionality or concept behind this invention.

The shielded cable assembly 160 is of the same construction as that contained in the basic modification kit 10, however since the electronics is different, the shielded cable assembly 160 is likewise mechanically modified to accommodate the differences. Such differences would be readily apparent to someone skilled in the art.

Another option that bears mentioning relative to the shielded cable assembly 160 and its output jack 170 is associated with acoustic guitars that have built-in piezoelectric transducers and preamplifiers. In this configuration one has the option to either leave the piezoelectric transducers and preamplifiers as is, thus making them independent from this extended modification kit 10, or the existing electronics can be integrated with this extended modification kit 10. In the case of leaving the piezoelectric transducer independent, the basic modification kit 10 or the extended modification kit 50, can be independently installed and have its own independent output jack 170.

In the case of integrating the existing piezoelectric electronics with the extended modification kit 50, one would run the piezoelectric transducer through the switch box 200 as one of the switchable transducer 138 configuration options. One could then also integrate the output jack 170 so that there is only one output jack 170 required since the signal going to that output jack 170 would be controlled by the circuitry provided by the extended modification kit 50.

Overall, whether using the basic modification kit 10, or the extended modification kit 50, the inherent sound characteristics of the guitar are minimally affected when the guitar is not electrically connected to external amplification and/or audio mixing equipment.

Figure 3:
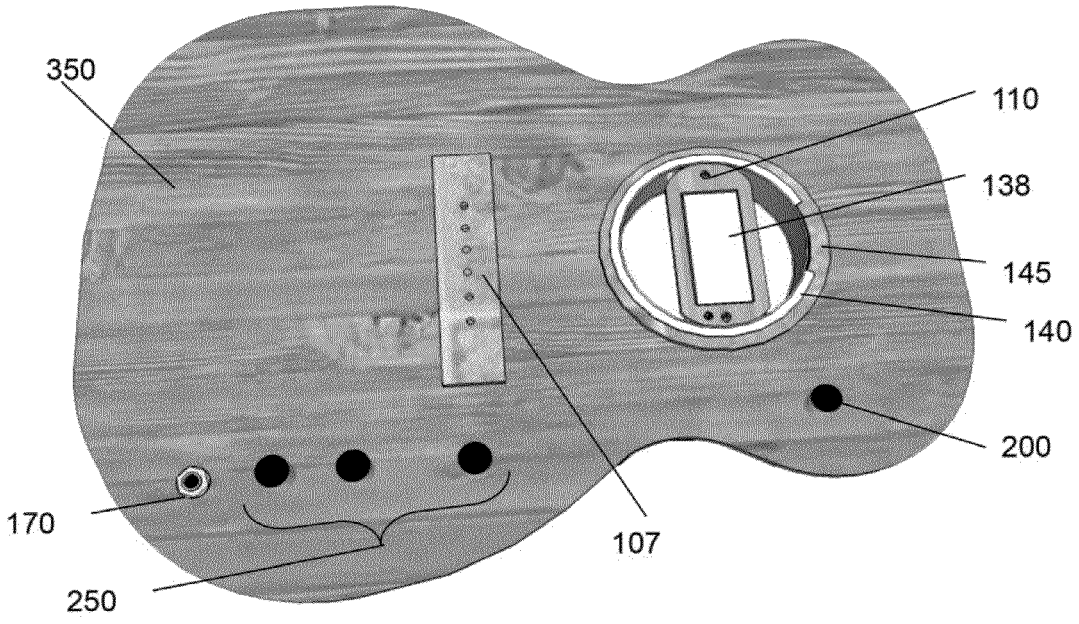
FIG. 3 is a top view of the installed extended modification kit showing the location of the major elements comprising said extended modification kit relative to their general position on the top of an acoustic guitar. The figure shows the knobs for the switch box and the control box in the positions shown as a preferred implementation of the invention. But of course, other locations for these controls may be used relative to their positions on the guitar.

FIG. 3 is a top view of the installed extended modification kit 50 showing the location of the major elements comprising said extended modification kit 50 relative to their general position on the top of an acoustic guitar as located in the preferred embodiment. The figure shows the knobs for the switchbox and the control box 250 in the positions shown as a preferred implementation of the invention. But of course other locations for these controls may be used relative to the top side of the guitar top 350.

FIG. 3 also shows the installed location of the feedback reduction device 140 into the sound hole 145 of the guitar. Note that the feedback reduction device 140 contains an upper lip that expands over the sound hole 145. It is this upper lip extension of the feedback reduction device 140 that keeps it from falling through the sound hole 145. Ultimately the initial positioning of the transducer 138 relative to the top surface of the top side of the guitar top 350 needs to be such that they are all in one plane. The transducer pickup holder 110 is designed such that it will allow an up and down adjustment of the transducer 138 of up to one quarter of an inch so that precise alignment can be made relative to the fixed metalized guitar string locations once all the basic modification kit 10 component's are installed. This implementation further provides the ability to then rotate the resulting transducer 138 face within the sound hole 145 in a plane parallel to the sound hole 145 thus providing another dimension in fine tuning of the transducer 138 to the metalized guitar strings 190.

Figure 4:
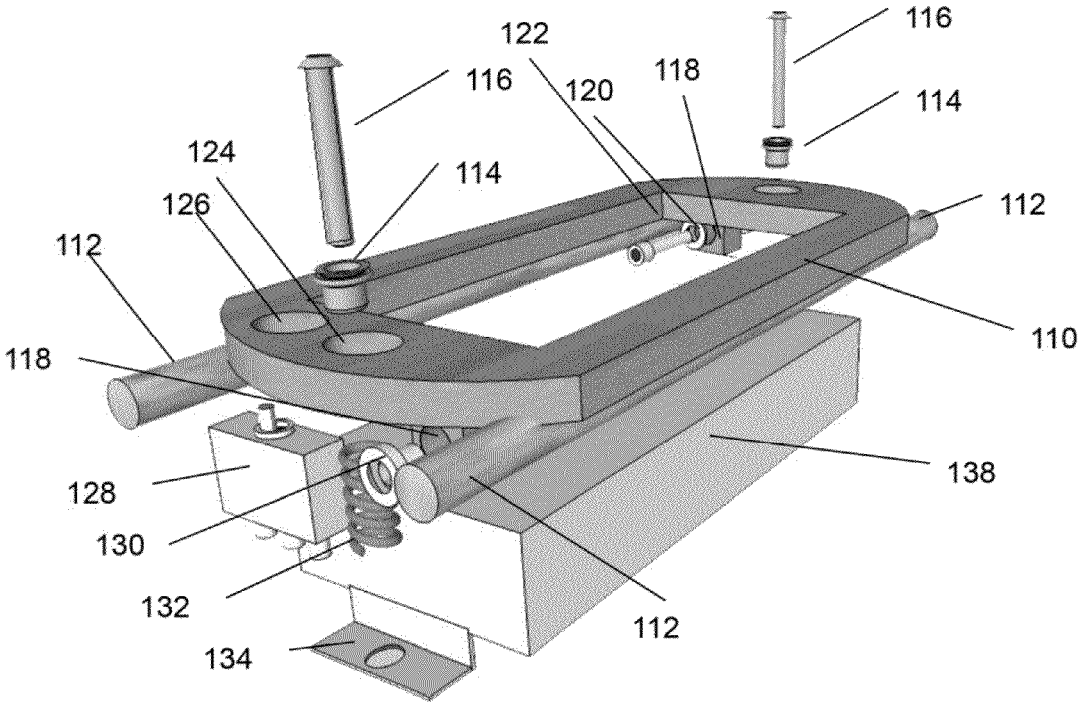
FIG. 4 is an exploded view of the pickup holder with the transducer as positioned relative to installation utilizing the various hardware attaching elements that make up this portion of the basic modification kit.

FIG. 4 is an exploded view of the pickup holder with the transducer 138 as positioned relative to installation utilizing the various hardware attaching elements that make up this portion of the basic modification kit 10.

The holder itself should be as small and as light weight as it needs to be in order to structurally hold the transducer 138 in place and be configured such that it can be snugly attached to the inner wall of the feedback reduction device 140. The material strength characteristics of the transducer pickup holder 110 needs to be able to accommodate of the weight of the transducer 138 as well as the vibration and shock motions that will be induced by the musician ultimately using the instrument. The thickness of the material used for the transducer pickup holder 110 should be as thin as possible while maintaining the mechanical structure previously discussed necessary to support the transducer 138. The reason for the thinness of the transducer 138 is that thinner appears to be better because thinner presents less interference to the production of the sound waves generated by the acoustic guitar.

The materials used for the transducer pickup holder 110 may be wood, aluminum, plastic, composite material, etc., as long as the structural requirements previously discussed our achieved. In this implementation, ⅛ inch birch plywood composite was used successfully.

The inner dimensions for the transducer pickup holder 110 is such that the resulting cut out is in the shape of the outer dimensions of the transducer 138. The cut out of the transducer pickup holder 110 was implemented using a router with a jig to cut out the square in the exact shape of the outer dimensions of the transducer 138 body.

The transducer 138 pickup holder through hole for transducer 124 was drilled in two places to align with the transducer 138 mounting flanges. The size of these pickup holder through hole for transducer 124 holes are such that they snugly accommodate the rivet nut 114 that is used through the top of the transducer pickup holder 110. This rivet nut 114 serves the dual purpose of providing a precision interface between the pickup holder through hole for transducer 124 and the transducer adjustment screw 116. In this case stainless steel material was used for the transducer adjustment screw 116 and the rivet nut 114 as well as the transducer positioning spring 132.

The net combination of the transducer adjustment screw 116, as it passes through the rivet nut 114, and the rivet nut 114, then secures to the top of the transducer pickup holder 110, while the transducer adjustment screw 116 passes through the transducer 138 transducer positioning spring 132 and ultimately attaches to the built-in nut plate located on the transducer mounting flange 134. It is this net combination of hardware that attaches the transducer 138 to the transducer pickup holder 110.

This combination of material provided solid and smooth interface between the transducer pickup holder 110 and the transducer 138 in that this combination of elements is required to enable the transducer 138 to be mechanically aligned with precision relative to the transducers top surface relative to the underside of the metalized guitar strings 190. Other materials for this mounting hardware can be used such as nylon or aluminum as long as the resulting difference in performance is acceptable to the user.

The transducer pickup holder 110 contains another hole that is called the pickup holder through hole for selection switch 126. In this embodiment this switch is a miniature multiple position selection switch 128 that may be mounted to the underside of the pickup holder in order to enable some additional switching combinations to the user. In this case the multiple position selection switch 128 was a three position device with two poles. In this particular application this allowed for the selection of one of two sets of transducers: a magnetic transducer, a piezoelectric transducer, or both. This ability to select the basic transducer 138, coupled with the switch box 200, provides greater flexibility in the eventual sound selection.

The transducer pickup holder 110 contains two pickup holder dowel 112 that are attached to the underside of the transducer pickup holder 110. The attachment of the pickup holder dowel 112 to the transducer pickup holder 110 is adhesive bonding in this case. In this application a ⅛ inch dowel was used. On the underside of the transducer pickup holder 110 a rounded groove to exactly accommodate the dowel was machined utilizing a router. The depth of the groove cut into the bottom of the transducer pickup holder 110 was approximately 1/32 of an inch.

This method of mechanical alignment of the dowel to the underside of the transducer pickup holder 110 enables the resulting bondage joint to be mechanically stable. The length of the pickup holder dowel 112 is slightly greater than the outer circumference measurement of the transducer pickup holder 110 itself at its greatest center dimension, which corresponds to being slightly longer than the inner wall dimensions of the feedback reduction device 140.

The purpose of the pickup holder dowel 112 are to enable the ability to snugly insert the transducer pickup holder 110 into the feedback reduction device 140 that contains the corresponding hole for pickup holder positioning dowel 144. This is best accomplished by first installing the feedback reduction device 140 into the guitar sound hole 145, and then inserting the transducer pickup holder 110 from the underside where the feedback reduction device 140 walls are much more flexible.

The length of the pickup holder dowel 112 must be such they are short enough to allow insertion in the manner described, yet long enough to securely hold the transducer pickup holder 110 with the transducer 138 mounted securely in place. Another constraint on the length of the pickup holder dowel 112 is that it must be short enough to enable the removal of the basic modification kit 10 should it be necessary, without the need to destroy the feedback reduction device 140. In general, the pickup holder dowel 112 length is such that it extends approximately ⅛ of an inch beyond the outer wall of the mating feedback reduction device 140.

One of the more significant challenges with this overall arrangement of mounting the transducer pickup holder 110 to the feedback reduction device 140 is due to the resulting mass of the transducer assembly is sufficient enough that without some further invention this resulting mass deforms the upper lip of the feedback reduction device such that the resulting distortion allows the transducer assembly to work its way through the sound hole 145 and thus the modification components eventually fall into the body of the acoustic guitar.

This type of event where the transducer component's would fall into the body of the acoustic guitar would be highly undesirable should it be allowed to occur. Thus the purpose of the alignment stop block 118 and its associated hardware, where said purpose is to prevent the mass of the transducer 138 assembly components from working their way into the acoustic guitar body by transferring the weight of the assembly component mass from the underside of the lip of the feedback reduction device 140 as it is mounted to the top side of the guitar top 350, to a pair of position capture blocks 150 with are securely attached to the underside of the guitar top 300.

The alignment stop block 118 is contained on diagonal corners on the underside of the transducer pickup holder 110. The alignment stop block 118 allows passage of a capture screw 122 that is passed through the alignment stop block 118 through a corresponding hole in the feedback reduction device 140, called the hole for pickup holder capture block screw 146, such that this capture screw 122 aligns itself into a slot on the pair of position capture blocks 150.

The pair of position capture blocks 150 are adhesively bonded to the underside of the guitar top and contains a slot where the capture screw 122 enters. Once the capture screw 122 is engaged into the slot on the pair of position capture blocks 150, the transducer pickup holder 110 can only move in a rotational plane that is parallel to the sound hole 145. That is that the transducer pickup holder 110 cannot fall into the guitar due to the structure that is now aligning it to the underside of the guitar top 300.

The alignment stop block 118 consists of three other pieces of hardware which enable the capture function to work. These other three pieces are: the capture screw 122, the washer for the stop block capture screw 122, and a t-nut for alignment stop block capture screw 130. Since these alignment stop block 118 is securely attached to the underside of the transducer pickup holder 110, the t-nut being inserted on the outer portion of the transducer pickup holder 110 provide a means to securely position the capture screw 122 to keep it aligned with the external slot that it will interface with.

In this implementation of the invention, the capture screw 122, the washer for stop block capture screw 120, and the t-nut for alignment stop block capture screw 130, are all made of stainless steel materials, but other materials can also be used such as aluminum or nylon depending on material availability and user preference.

Figure 5:
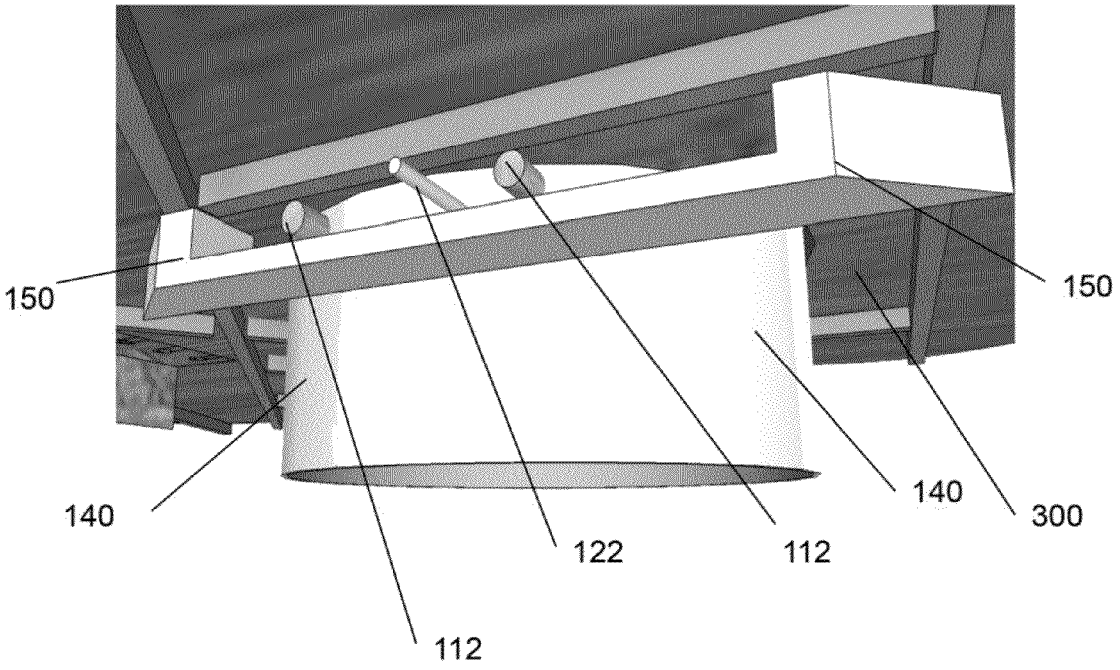
FIG. 5 is an isometric view showing one side of the two position capture blocks as shown attached to the underside of the guitar top. The position capture blocks are shown in relation to the feedback reduction device and the transducer pickup holder all shown in their respective installed positions. The structure of the pair of position capture blocks is such that the resulting installation provides a slot for the capture screw such that the transducer pickup holder can only rotate in one plane.

FIG. 5 is an isometric view showing one side of the two position capture blocks as shown attached to the underside of the guitar top 300. The position capture blocks 150 are shown in relation to the feedback reduction device 140 and the transducer pickup holder 110 all shown in their respective installed positions. The structure of the pair of position capture blocks 150 is such that the resulting installation provides a slot for the capture screw 122 such that the transducer pickup holder 110 can only rotate in one plane.

The resulting rotation plane is a plane that is parallel to that of the sound hole 145. This position capture capability has several functional characteristics, one of which is that these position capture blocks keeps the added mass of the transducer pickup holder 110 with the transducer 138 as it is attached to the flexible feedback reduction device 140 from pulling through the top side of the guitar top 350 sound hole 145 and falling into the internals of the acoustic guitar. Another functional characteristic that is worthy of special mention is the ability to allow precise rotational alignment which will be discussed further in subsequent paragraphs.

The shape of the pair of position capture blocks 150 is such that it complements the structure found on the underside of the guitar top. In this implementation the pair of position capture blocks 150 were adhesively bonded to the structure on the underside of the guitar top 300. Two-sided tape might also be acceptable for the attachment of the pair of position capture blocks 150 to the underside of the guitar top 300, as well as other mechanical means for attachment.

The material used in this implementation for the pair of position capture blocks 150 was maple hardwood, but other woods and/or materials could be utilized just as well depending on individual taste and materials availability. The length of the slot is selected such that the slot length will enable a rotation angle of the least +/−5° and up to +/−30° of the capture screw 122 within the pair of position capture blocks 150. The benefit of this adjustment is that it allows for the precision rotation of placement of the transducer 138 relative to the metalized guitar strings 190. This rotational positioning capability of the angular relationship between the transducer 138 and the metalized guitar strings 190 changes the characteristics of the electrical sound signature ultimately produced.

An alternate approach, which would substitute for the need of the pair of position capture blocks 150, and thus would eliminate both the pair of position capture blocks 150 as well as all of its associated interconnect hardware, would be to modify the feedback reduction device 140 in a manner where the weight of the transducer pickup holder 110 with transducer 138 would not result in pulling the feedback reduction device 140 through the sound hole 145 and into the guitar body.

This increased structural strength of the feedback reduction device 140 can be accomplished in at least one of several ways. One method would be to increase the width of the upper lip of the feedback reduction device 140 which is located on the top side of the guitar top 350. Another method would be to make the upper corner of the feedback reduction device 140, the area where the upper lip makes a right angle to the feedback reduction device 140 cylindrical body, rigid enough such that the upper lip can then support without physically deforming, the added weight attributed to the transducer pickup holder and its associated transducer as they are mounted to the guitar sound hole 145.

Still another method to support the feedback reduction device 140 might be to provide physical structure between the inside the guitar body lower edges of the cylindrical feedback reduction device and the inside bottom floor of the guitar body such that the feedback reduction device 140 containing the transducer pickup holder 110 with transducer 138 are supported such that it can no longer distort the upper lip of the feedback reduction device 140 thus preventing it from pulling through the sound hole 145.

If the rotational position of the transducer does not require the capability to be continuously adjustable, then the slotted position capture blocks 150 can be configured with a hole, instead of a slot, in which the hole is aligned to accept its corresponding capture pin that is anchored to the transducer pickup holder 110 such that the holder cannot move in an up or down direction. As before, the capture pin when inserted into the resulting hole that is made by the pair of position capture blocks 150 keeps the transducer 138 and its mounting structure from falling into the body of the guitar.

Figure 6:
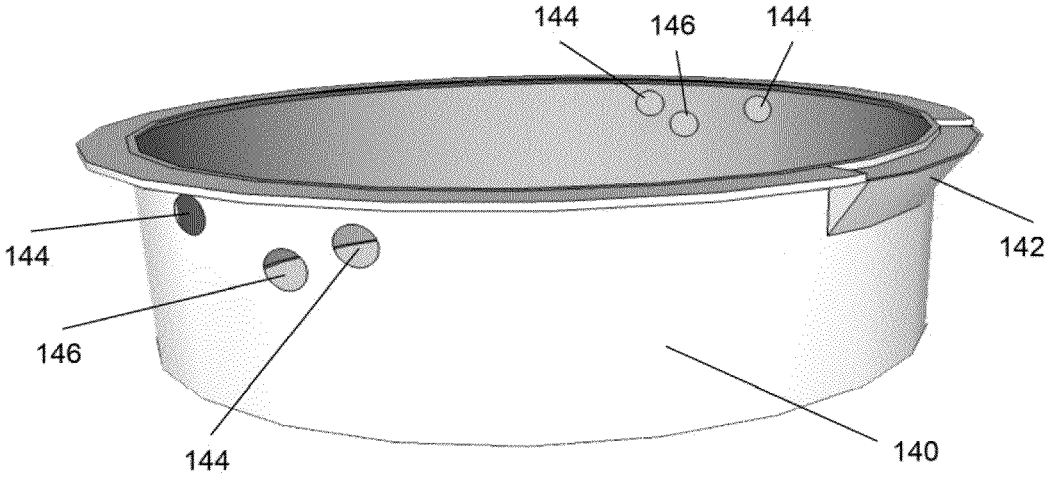
FIG. 6 is an isometric view of the modified feedback reduction device showing the construction detail required to enable mounting of the feedback reduction device to the acoustic guitar sound hole as well as enable the installation of the pickup holder assembly to the inner wall of the feedback reduction device. The feedback reduction device used in this implementation is a commercially available device that is made of a flexible plastic material such that it can be compressed and made to snugly fit into the sound hole of an acoustic guitar.

FIG. 6 is an isometric view of the modified feedback reduction device 140 showing the construction detail required to enable mounting of the feedback reduction device 140 to the acoustic guitar sound hole 145 as well as enable the installation of the pickup holder assembly to the inner wall of the feedback reduction device 140. The feedback reduction device 140 used in this implementation is made of a flexible plastic material such that it can be compressed and made to snugly fit into the sound hole 145 of an acoustic guitar.

The commercially available feedback reduction device 140 requires modification in order to enable the installation of the transducer pickup holder 110. The modification consists of drilling or punching six holes in the wall of the feedback reduction device 140. The feedback reduction device 140 is positioned in the sound hole 145 with the cut out on the top lip positioned toward the neck of the acoustic guitar. The modification holes are placed on opposite walls that are at right angles to the position of the cut out in the upper lip of the feedback reduction device 140. This positioning allows the transducer 138 to ultimately be nominally at right angles to the metalized guitar strings 190 once the transducer pickup holder 110 is mounted within the feedback reduction device 140.

All six of the modification holes are approximately ⅛ inch diameter. The size and the location of these holes align with the transducer pickup holder 110 pickup holder dowel 112 and the transducer pickup holder 110 capture screw 122. These holes are positioned relative to the top of the upper lip such that when the transducer pickup holder 110 is mounted with the transducer 138 installed that the mid-adjustment for the up-and-down motion within the feedback reduction device 140 is such that the transducer 138 top surface is even with the upper lip of the feedback reduction device 140. When aligned in this manner, the net result is an approximate ⅛ inch up and down adjustment relative to the location of the fixed location of the metalized guitar strings 190.

The six modification holes to the feedback reduction device 140 are comprised of two sets of three holes each. Each set of three holes consists of two outer holes which provide hole for pickup holder positioning dowel 144, and a center hole which provides the hole for pickup holder capture block screw 146.

Also shown in FIG. 6 is gasketing material 142 that is attached under the upper lip of the feedback reduction device 140 such that when the feedback reduction device 140 is installed into the acoustic guitars sound hole 145, the gasketing material 142 ends up on the underside of the guitar top 300. Testing has shown that installing this gasketing material 142 makes for a tighter fit of the feedback reduction device 140 into the acoustic guitar sound hole 145 resulting in improved feedback reduction, as well as a mechanically more secure transducer pickup holder 110 structure.

Installation of the gasketing material 142 installed in the neck interface area may be sufficient as shown in FIG. 6, however extending this gasketing material 142 around the entire 360° circumference under the upper lip of the feedback reduction device 140 is also an acceptable and useful configuration. When applying the gasketing material 142 all the way around the feedback reduction device 140, it may be then necessary to remove the gasketing material 142 as it passes over those areas containing the modification mounting holes.

The gasketing material 142 in this implementation is a triangular shaped cross-section silicone-based self sticking weather stripping sized to fit the application which in this case was approximately ⅜ of an inch per side. Other similar soft materials such as nylon mesh or cork can also be used in this application. Similarly other gasketing material 142 cross sectional shapes may be used to the same effect such as rectangular, circular, square, etc.

Figure 7:
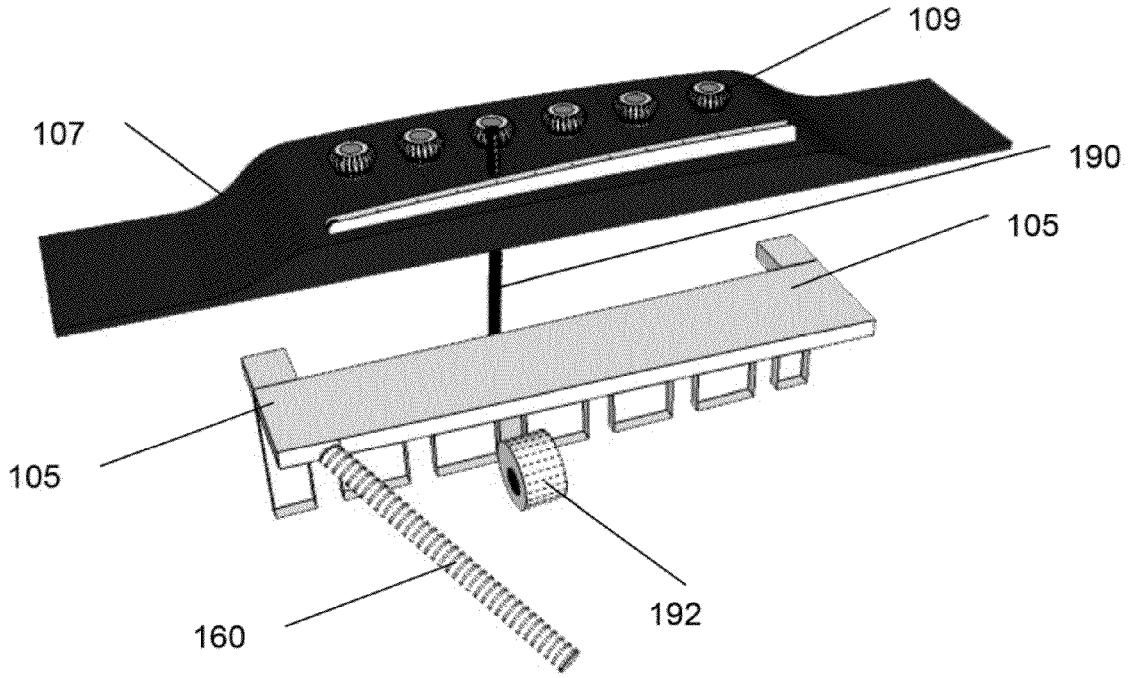
FIG. 7 is an isometric view of the conductive guitar string anchor bracket showing how a metalized guitar string would be attached to said conductive anchor bracket and then how the metalized guitar string would be routed through the bridge plate, located on the top side of the guitar top. Also shown in FIG. 7 is the connection of a grounding cable that is part of the shielded cable assembly to said conductive string anchor bracket so that an electrical connection can be made to the electronics section located in the control box.

FIG. 7 is an isometric view of the conductive guitar string anchor bracket showing how a metalized guitar string would be attached to said conductive anchor bracket and then how the metalized guitar string would be routed through the bridge plate 107, located on the top side of the guitar top 350. Also shown in FIG. 7 is the connection of a grounding cable that is part of the shielded cable assembly 160 to said conductive string anchor bracket 105 so that an electrical connection can be made to the electronics section located in the control box 250.

The conductive string anchor bracket 105 is made of a metallic conducting material, such as either brass or copper being preferred since the ground cable from the shielded cable assembly 160 can be soldered to the conductive string anchor bracket 105. The conductive string anchor bracket 105 is a commercially available item that is modified in this application with the addition of the grounding cable in order to enable a means to electrically close the circuit between the metalized guitar strings 190 and the transducer 138 in order to make that acoustic guitar have an electric guitar feature.

The conductive string anchor bracket 105 terminates the metalized guitar strings 190 as they route through the bridge plate 107 in a manner such that the guitar string termination ball 192 is captured by the slot that is mounted directly beneath the bridge plate 107 string holes. The conductive string anchor bracket 105 is attached to the underside of the guitar top by adhesive, which is the preferred method, however other means of attachment are possible such as two-way tape or screws.

Once the metalized guitar strings 190 are installed through the bridge plate 107, a set of traditional bridge pins 109 can then be installed if desired. The bridge pins 109 are not necessary in this configuration, however based on individual preference may still be desired. The preferred attachment method of the grounding cable via the shielded cable assembly 160 is to attach said grounding cable to the conductive string anchor bracket 105 utilizing solder, however other mechanical means can be used to the same effect, such as mechanical connection via a terminal or a crimp.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

The invention claimed is:

1. A modification kit for use with a hollow body acoustic guitar where said modification kit provides capability for high gain amplification without feedback squeal, wherein said modification kit consists of:

- a magnetic transducer; and
- a transducer holder which also acts as interface to the feedback reduction device; and
- a feedback reduction device which mounts in the sound hole of said guitar; and
- a set of metalized guitar strings which are terminated into a conductive string anchor bracket; and
- a conductive string anchor bracket contains an attachment wire that is used to electrically close the loop with other electronics.

2. The invention of claim 1, wherein the modification kit may also have:

- a volume control with or without frequency filtering capabilities; and
- a transducer control switching module; and
- an angular/rotational adjustment capability of the transducer head relative to the fixed string positions on the guitar to enabled fine tuning; and a height/up or down adjustment capability of the transducer head relative to the fixed string positions on the guitar to enabled fine tuning; and a set of stop blocks to constrain the rotational adjustment range and as well as serving as a mechanism to prevent the transducer assembly from detaching from the guitar sound hole.

3. A transducer pickup holder, configured such that the transducer can be attached to the holder which in turn can then be attached to the inner wall of a feedback reduction device for the purpose of enabling high gain amplification of a hollow body acoustic guitar with the device elements consisting of:

A means for independent transducer face position height adjustment capability in the up and down direction relative to the fixed position of the guitar strings; and A means for rotational adjustment of the transducer at that fixed adjustment height provide fine tuning capability for the transducer relative to the guitar strings.

4. The invention of claim 3, wherein there is a conductive guitar string anchor bracket use in conjunction with metalized guitar strings:

the anchor bracket is constructed of a conductive and solderable material, such as either brass or copper, such that a grounding conductor can be securely and easily soldered to the conductive string anchor bracket;

the anchor bracket with soldered grounding conductor enables an electrical connection to then be made to an electronics section;

a grounding conductor when attached to the modified conductive string anchor bracket, in conjunction with the metalized guitar strings, provides a means to electrically close the circuit between the electro-mechanical interaction of the metalized guitar strings and the magnetic pickup in order to safely and effectively make an acoustic guitar have an electric guitar feature.

5. The invention of claim 3, wherein there are rotational position capture blocks:

where the position capture blocks are securely attached to the underside of the guitar top; and the position capture blocks may contain either (a) a slot where the capture screws, which are originating from the transducer pickup holder, are captured in the position capture blocks or (b) at least one corresponding screw hole in each capture block; and the capture screws from the transducer pickup holder are engaged into the corresponding slots (or screw holes when continuous rotational adjust is not needed/desired) on the pair of position capture blocks; and the transducer pickup holder is thus restricted to the rotational plane that is parallel to the sound hole; and the transducer pickup holder assembly is now prevented from working way through the guitar sound hole due to the structure that is now aligning the transducer elements to the underside of the guitar top.

* * * * *